US010000887B2

(12) United States Patent
Salazar

(10) Patent No.: US 10,000,887 B2
(45) Date of Patent: Jun. 19, 2018

(54) HAIR EXTENSION DRYING APPARATUS

(71) Applicant: Iris Salazar, Miami, FL (US)

(72) Inventor: Iris Salazar, Miami, FL (US)

( * ) Notice: Subject to any disclaimer, the term of this patent is extended or adjusted under 35 U.S.C. 154(b) by 0 days. days.

(21) Appl. No.: 15/491,833

(22) Filed: Apr. 19, 2017

(65) Prior Publication Data

US 2018/0066394 A1 Mar. 8, 2018

Related U.S. Application Data

(60) Provisional application No. 62/495,106, filed on Sep. 2, 2016.

(51) Int. Cl.

| | |
|---|---|
| ***A45D 20/00*** | (2006.01) |
| ***D06F 59/00*** | (2006.01) |
| ***A47F 7/06*** | (2006.01) |

(52) U.S. Cl.

CPC ..... *D06F 59/00* (2013.01); *A47F 7/065* (2013.01)

(58) Field of Classification Search

CPC ..... D06F 59/00; A47F 7/065; A45D 20/00; A47B 17/00

USPC ..... 34/239, 97–100

See application file for complete search history.

(56) References Cited

U.S. PATENT DOCUMENTS

| | | | | |
|---|---|---|---|---|
| 1,341,405 | A * | 5/1920 | Woodard | A45D 20/16 165/53 |
| 2,013,572 | A * | 9/1935 | McCord | A45D 20/14 219/492 |
| 2,244,953 | A * | 6/1941 | Klingensmith | A45D 20/22 34/100 |
| 4,180,050 | A * | 12/1979 | Sizemore | A47J 37/0731 126/25 A |
| 4,242,810 | A * | 1/1981 | Blanco | A45D 20/16 34/88 |
| 4,278,223 | A * | 7/1981 | Fauteux | A45D 20/00 219/242 |

(Continued)

FOREIGN PATENT DOCUMENTS

| | | | | |
|---|---|---|---|---|
| EP | 0 555 641 | A1 * | 2/1993 | |
| FR | 2341709 | A1 * | 9/1977 | A45D 20/04 |

(Continued)

*Primary Examiner* — Stephen M Gravin

(74) *Attorney, Agent, or Firm* — Ruben Alcoba, Esq.

(57) ABSTRACT

A hair extension drying apparatus that comprises of a pedestal having a left, a right, a front, and a rear side. A column that is attached to the pedestal. A platform that that has a front and a rear side, the front side of the platform defines a vertical wall has a top and a bottom side, the top side of the vertical wall has a swivel, and the platform is attached to the column. A 3d L-shaped top that attaches to the swivel so that the vertical wall of the platform is flush with the 3d L-shaped top, the L-shaped top has a top and a bottom, the bottom side of the 3d L-shaped top defines a centrally positioned vertical wall that defines an aperture. A pair of springs, each spring is secured to the platform and the 3d L-shaped top so that the springs are aligned parallel to the front side of the platform, the springs are positioned at a location that is adjacent to the rear side of the platform. A line that is attached to the aperture of the centrally positioned vertical wall. And, a pedal that has a pedal swivel that is secured to the base and that attaches to the line so that pedal is always in an upward position toward the rear side of the pedestal.

3 Claims, 5 Drawing Sheets

(56) References Cited

U.S. PATENT DOCUMENTS 4,453,695 A * 6/1984 Sennott ..... A45D 20/12 248/278.1
4,576,028 A * 3/1986 Morita ..... B21F 3/04 72/138
4,627,345 A * 12/1986 Watts ..... B41F 15/0809 101/119
4,809,444 A * 3/1989 Henderson ..... A45D 4/10 34/98
5,064,154 A * 11/1991 Payne ..... A45D 20/12 248/121
5,184,468 A * 2/1993 Schonlau ..... B60T 7/04 60/535
5,613,305 A * 3/1997 Narrin ..... A45D 20/12 34/90
5,636,815 A * 6/1997 Wilson ..... A45D 20/12 248/125.3
5,640,781 A * 6/1997 Carson ..... A45D 20/16 132/229
5,737,847 A * 4/1998 Britton ..... A45D 20/14 34/97
5,832,624 A * 11/1998 Narrin ..... A45D 20/12 34/97
5,970,622 A * 10/1999 Bahman ..... A45D 20/00 34/97
6,199,805 B1 * 3/2001 Pena ..... A45D 20/12 248/125.8
6,205,679 B1 * 3/2001 Rodway ..... F26B 21/001 34/487
6,390,424 B1 * 5/2002 Kidushim ..... A45D 20/12 248/122.1
7,984,567 B2 * 7/2011 Bertakis ..... A45D 20/00 132/329
8,151,481 B2 * 4/2012 Perez, Jr. ..... A45D 20/14 248/160
9,408,452 B1 * 8/2016 Al-Khulaifi ..... A45D 20/12
2003/0218370 A1 * 11/2003 Langham ..... A47C 3/18 297/344.22
2006/0076464 A1 * 4/2006 Van ..... A45D 20/12 248/122.1
2007/0221813 A1 * 9/2007 Blum ..... A45D 44/02 248/520
2008/0016712 A1 * 1/2008 Van ..... A45D 20/12 34/283

FOREIGN PATENT DOCUMENTS

JP 04017807 A * 1/1992
JP 2005332642 A * 12/2005
WO WO 8909554 A1 * 10/1989 ..... A45D 20/122

* cited by examiner

HAIR EXTENSION DRYING APPARATUS

BACKGROUND

The present invention is directed to a hair extension drying apparatus that is used to work on curtain style extensions, clip-on extensions, and DEYSI FUENTES extensions.

The inventor of the present invention is a hair stylist that specializes in preparing hair extensions that are placed on humans.

One of the difficulties of working with extensions is that they must be secured to a holding means when straightening, coloring or cutting the extensions.

In practice, some stylists have other stylist secure the extensions when working on them: this is hazardous to the person holding the extension, for they are often burnt or are forced to inhale chemicals used to treat the extensions.

Other stylists place the extensions on clips that are attached to other objects. Often, the clips snap off the objects and the extensions fall to a surface, thereby causing the extensions to be blemished or damaged.

For the foregoing reasons, there is a need for a hair extension drying apparatus that can be used to straighten, color or cut hair extensions.

SUMMARY

The present invention is a hair extension drying apparatus that is used to straighten, color or cut hair extensions.

A hair extension drying apparatus comprises of a pedestal having a left, a right, a front, and a rear side. A column that is attached to the pedestal. A platform that that has a front and a rear side, the front side of the platform defines a vertical wall has a top and a bottom side, the top side of the vertical wall has a swivel, and the platform is attached to the column. A 3d L-shaped top that attaches to the swivel so that the vertical wall of the platform is flush with the 3d L-shaped top, the L-shaped top has a top and a bottom, the bottom side of the 3d L-shaped top defines a centrally positioned vertical wall that defines an aperture. A pair of springs, each spring is secured to the platform and the 3d L-shaped top so that the springs are aligned parallel to the front side of the platform, the springs are positioned at a location that is adjacent to the rear side of the platform. A line that is attached to the aperture of the centrally positioned vertical wall. And, a pedal that has a pedal swivel that is secured to the base and that attaches to the line so that pedal is always in an upward position toward the rear side of the pedestal.

The present invention is used by placing a hair extension between the vertical wall of the platform and the 3d L-shape top. The springs between the platform and the 3d L-shaped top apply the pressure required to secure the hair extension within the vertical wall and 3d L-shaped top. The pressure is released by applying pressure to the pedal and thereby lifting the front side of the 3d L-shaped off the vertical wall of the platform. When the pressure is released, the hair extension can be placed or removed from the hair extension apparatus.

An object of the present invention is to provide a hair extension apparatus that will not require two people to work on the hair extension when straightening, coloring or cutting the hair extension.

Another object of the present invention is to provide a hair extension apparatus that will hold a hair extension in place when being worked on and that is easily secured and removed from the apparatus.

An further object of the present invention is to provide a hair extension apparatus that will speed up the preparation of a hair extension prior to placing it on a human.

DRAWINGS

These and other features, aspects, and advantages of the present invention will become better understood with regards to the following description, appended claims, and drawings where:

Figure 1:
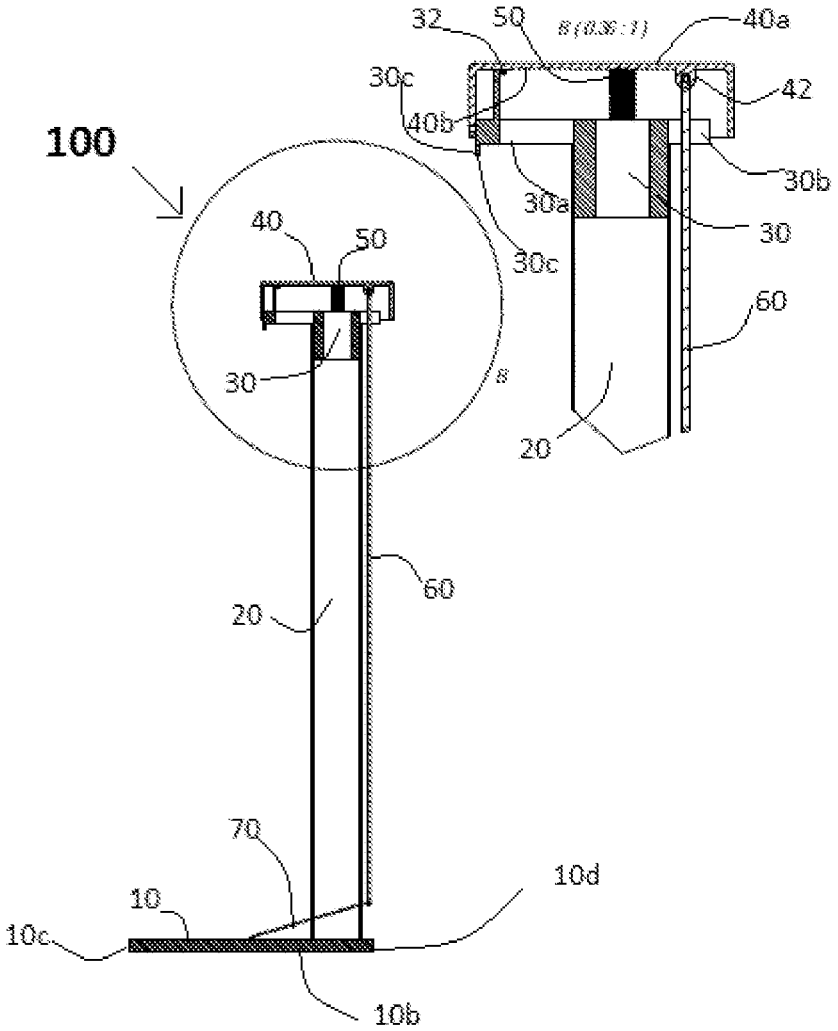
FIG. 1 is a right side view of the present invention having an exploded view of the top side.
Figure 2:
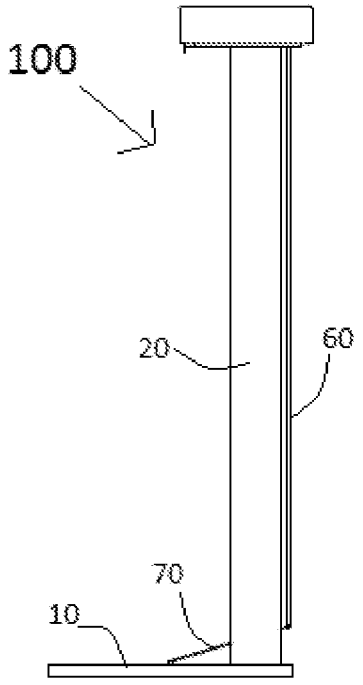
FIG. 2 is a right side view of the present invention.
Figure 3:
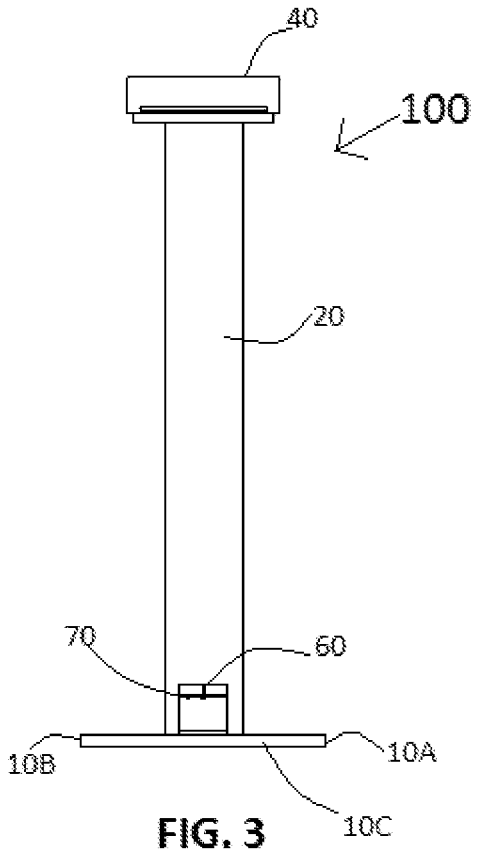
FIG. 3 is a rear view of the present invention.
Figure 4:
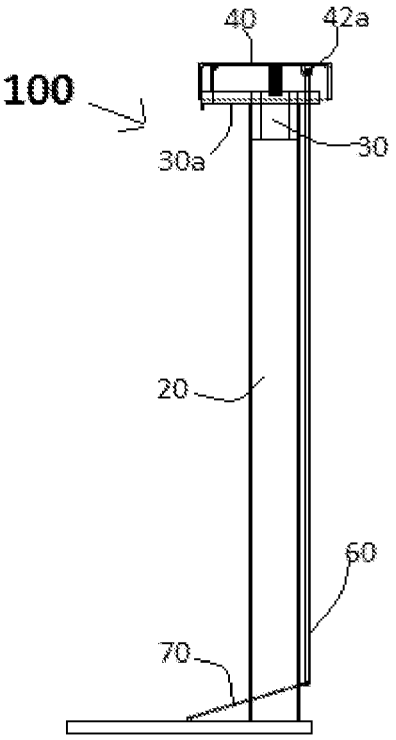
FIG. 4 is a sectional right side view of the present invention.
Figure 5:
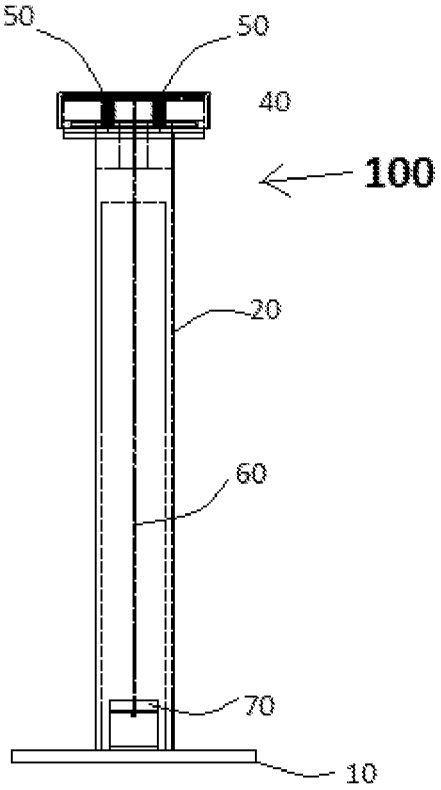
FIG. 5 is a sectional rear view of the present invention.
Figures 6, 6A, 6B:
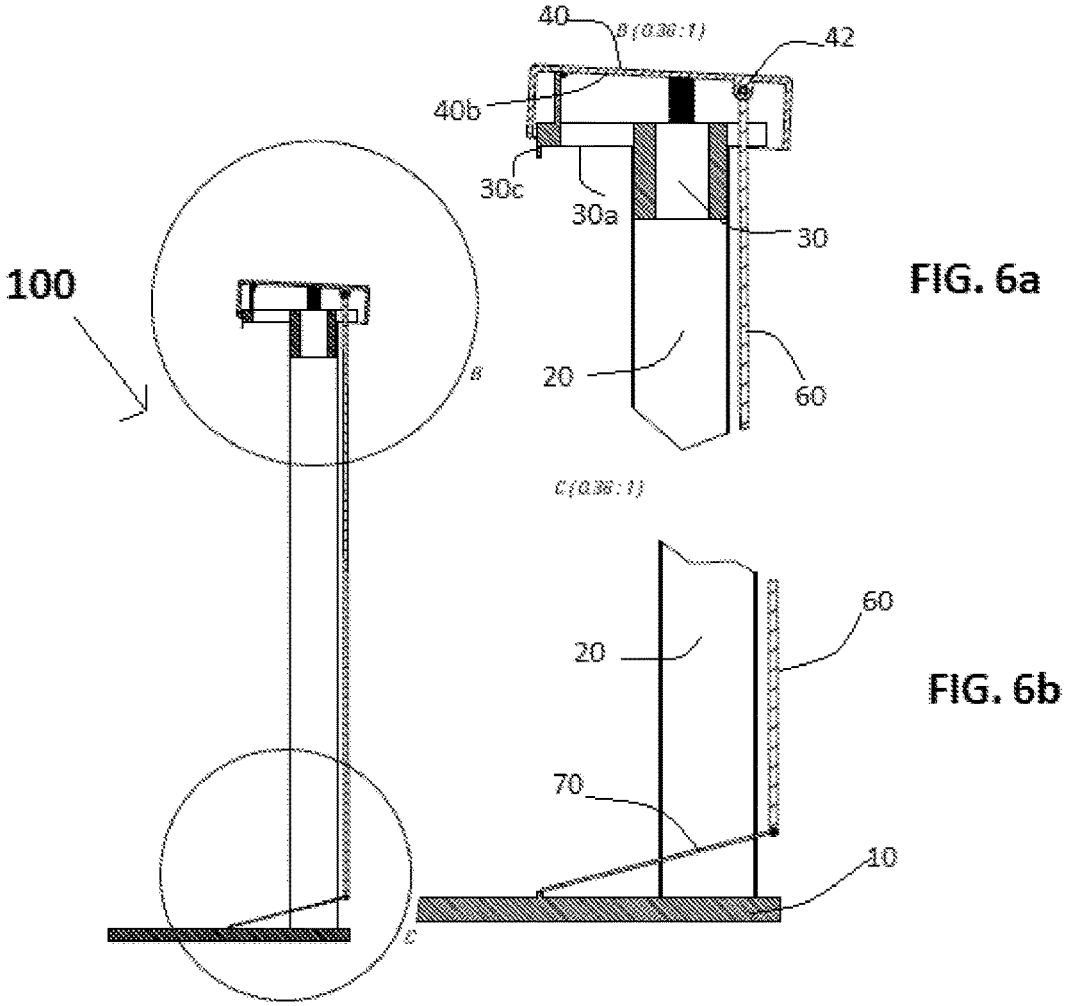
FIG. 6 is a right side view of the present invention showing two sections that will be exploded.
Figure 7:
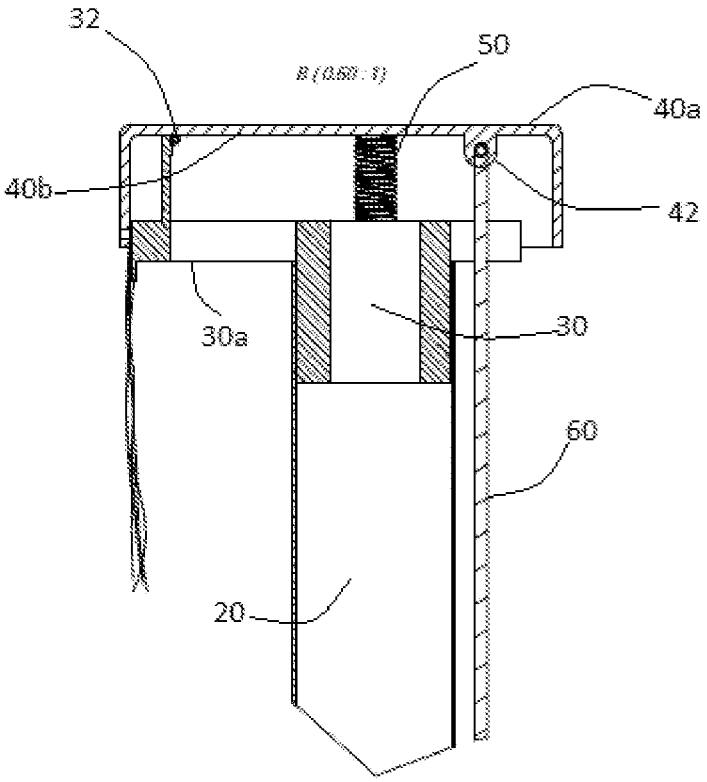

FIG. 6*a* is a sectional exploded view of the top side of the present invention;

FIG. 6*b* is a sectional exploded view of the bottom side of the present invention; and FIG. 7 is a sectional view of the present invention showing how a hair extension would be secured on the apparatus.

DESCRIPTION

As seen in FIGS. 1-5, the present invention is a hair extension drying apparatus 100. The drying apparatus 100 comprises a pedestal 10 having a left 10*a*, a right 10*b*, a front 10*c*, and a rear side 10*d*. A column 20 that is attached to the pedestal 10. A platform 30 that that has a front 30*a* and a rear side 30*b*. The front side 30*a* of the platform defines a vertical wall 30*c* has a top and a bottom side (not shown in figures). The top side of the vertical wall has a swivel 32. The platform 30 is attached to the column 20. A 3d L-shaped top 40 that attaches to the swivel 32 so that the vertical wall of the platform 30*c* is flush with the 3d L-shaped top 40 and the L-shaped top 40 has a top 40*a* and a bottom 40*b*. The bottom side of the 3d L-shaped top 40*b* defines a centrally positioned vertical wall 42 that defines an aperture. A pair of springs 50 and each spring 50 is secured to the platform 30 and the 3d L-shaped top 40 so that the springs 50 are aligned parallel to the front side of the platform 30*a*. The springs 50 are positioned at a location that is adjacent to the rear side of the platform 30*b*. A line 60 that is attached to the aperture of the centrally positioned vertical wall 42. And, a pedal 70 that has a pedal swivel (not shown in figures) that is secured to the base 10 and that attaches to the line 60 so that pedal 70 is always in an upward position toward the rear side of the pedestal.

In an embodiment of the present invention, the column 20 measures at least 48 inches and the front side of the platform measures at least 12 inches.

In another embodiment of the present invention, the pedestal 10 is made of metal and the front side 10*c* and the rear side 10*d* of the pedestal measures at least 20 inches and the left side 10*a* and the right side 10*b* measures at least 18 inches.

An advantage of the present invention is that it provides a hair extension apparatus that does not require two people to work on a hair extension when straightening, coloring or cutting the hair extension.

Another advantage of the present invention is that it provides a hair extension apparatus that holds a hair extension in place when being worked on and that is easily secured and removed from the apparatus.

An further advantage of the present invention is that it provides a hair extension apparatus that speeds up the preparation of a hair extension prior to placing it on a human.

While the inventor's above description contains many specificities, these should not be construed as limitations on the scope, but rather as an exemplification of several preferred embodiments thereof. Accordingly, the scope should not be determined by the embodiments illustrated, but by the appended claims and their legal equivalents.

What is claimed is:

1. A hair extension drying apparatus, the drying apparatus comprises:

a pedestal having a left, a right, a front, and a rear side;

a column that is attached to the pedestal;

a platform that that has a front and a rear side, the front side of the platform defines a vertical wall has a top and a bottom side, the top side of the vertical wall has a swivel, and the platform is attached to the column;

a 3d L-shaped top that attaches to the swivel so that the vertical wall of the platform is flush with the 3d L-shaped top, the L-shaped top has a top and a bottom, the bottom side of the 3d L-shaped top defines a centrally positioned vertical wall that defines an aperture;

a pair of springs, each spring is secured to the platform and the 3d L-shaped top so that the springs are aligned parallel to the front side of the platform, the springs are positioned at a location that is adjacent to the rear side of the platform;

a line that is attached to the aperture of the centrally positioned vertical wall; and a pedal that has a pedal swivel that is secured to a base and that attaches to the line so that pedal is always in an upward position toward the rear side of the pedestal.

2. The hair extension drying apparatus of claim 1, wherein the column measures at least 48 inches and the front side of the platform measures at least 12 inches.

3. The hair extension drying apparatus of claim 2, wherein the pedestal is made of metal and the front and rear sides of the pedestal measures at least 20 inches and the left and right sides measure at least 18 inches.

* * * * *